United States Patent [19]

Blackman

[11] Patent Number: 5,025,980

[45] Date of Patent: Jun. 25, 1991

[54] DOUBLE USE EXPRESS MAIL ENVELOPE

[75] Inventor: Stephen M. Blackman, Westmont, Ill.

[73] Assignee: Federal Paper Board Co., Inc., Montvale, N.J.

[21] Appl. No.: 552,226

[22] Filed: Jul. 13, 1990

[51] Int. Cl.[5] ..... B65D 27/06
[52] U.S. Cl. ..... 229/73; 229/70
[58] Field of Search ..... 229/73, 105, 70

[56] References Cited

U.S. PATENT DOCUMENTS

| | | | |
|---|---|---|---|
| 1,373,512 | 4/1921 | Kuhhorn | 229/73 |
| 2,238,468 | 4/1941 | Hayden | 229/105 |
| 3,111,257 | 11/1963 | Peach | 229/73 |
| 3,498,528 | 3/1970 | Klein | 229/73 |
| 3,512,702 | 5/1970 | Pritchard, Jr. | 229/73 |
| 3,558,040 | 1/1971 | Krueger | 229/73 |
| 4,194,631 | 3/1980 | Rangan | 229/73 |

FOREIGN PATENT DOCUMENTS

| | | | |
|---|---|---|---|
| 119165 | 9/1918 | United Kingdom | 229/73 |
| 120003 | 10/1918 | United Kingdom | 229/73 |

*Primary Examiner*—Stephen P. Garbe
*Attorney, Agent, or Firm*—Charles A. Brown

[57] ABSTRACT

This relates to a mailing envelope which may be utilized by one of the express mail services. The envelope is distinguished over existing envelopes by being provided with two closure flaps which permit the envelope to be utilized twice and possibly as a return envelope. In the first usage, the first closure flap is folded to an out of the way position beneath the second closure flap and becomes usable only after the second closure flap has been removed. The envelope also includes a removable label panel to which the second closure flap is initially bonded and is removed with the second closure flap when the envelope is first opened so as to permit the use of the second closure flap in the reclosing of the envelope and also to provide new surface to which mailing instructions, etc. may be applied.

15 Claims, 3 Drawing Sheets

DOUBLE USE EXPRESS MAIL ENVELOPE

This invention relates in general to new and useful improvements in mailing envelopes, and more particularly to a mailing envelope that has a double use.

In the present use of express mail services, a thicker than normal paper board envelope is utilized so as to assure the safe handling of the papers being sent. However, such envelopes have a single use. In accordance with this invention, it is proposed to provide an envelope which requires only a small amount of extra paper board but which has a double use and is particularly usable for return mailing. In accordance with this invention, the envelope is provided with two closure flaps, one of which is not in use during the first mailing and the other of which is removed after the first mailing so that the first closure flap may be utilized in sealing the pocket of the envelope for the second mailing.

Further, in accordance with this invention, the envelope is provided with a removable panel for receiving the first mailing information. During the initial closing of the pocket, the second closure flap becomes bonded to this panel and the closure flap and the panel are removable as a unit so that that portion of the envelope underlying the removable panel may be utilized for receiving second mailing instructions.

With the above and other objects in view that will hereinafter appear, the nature of the invention will be more clearly understood by reference to the following detailed description, the appended claims, and the several views illustrated in the accompanying drawings.

Figure 1:
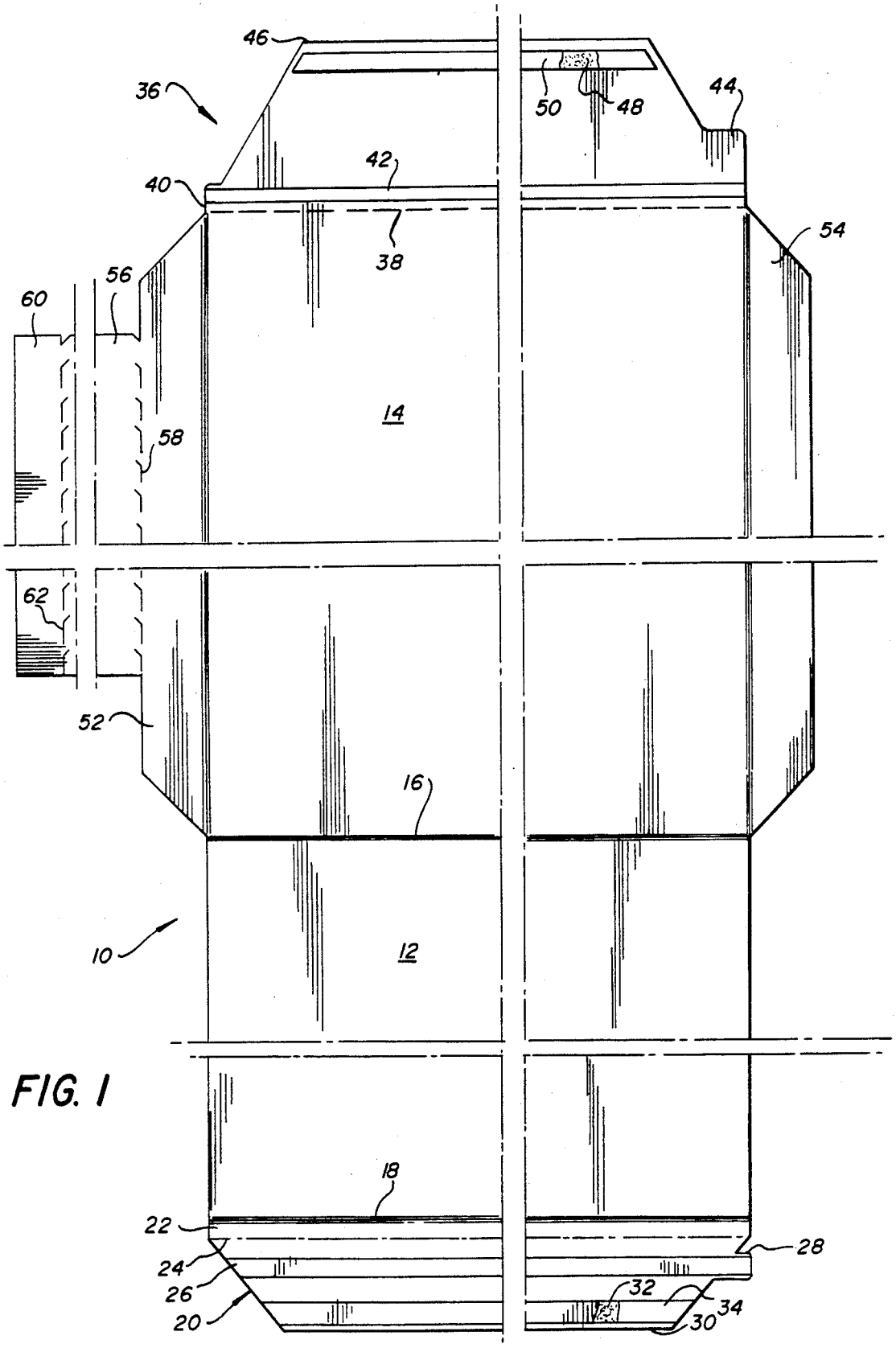
FIG. 1 is a plan view of a paper board blank for forming the mailing envelope, the view being from the interior surface of the blank.

Referring now to the drawings in detail, reference is first made to FIG. 1 wherein there is illustrated an envelope formed in accordance with this invention, the blank being formed of a single piece of paper board and being generally identified by the numeral 10. The inner surface of the blank 10 is illustrated.

The blank 10 basically includes a first rectangular panel 12 and a second rectangular panel 14 of equal rectangular size. The panels 12, 14 are joined together along an intermediate fold line 16 which is located at second ends of the panels 12, 14.

The first panel 12 has connected to a first end thereof along a fold line 18 a first closure flap 20. The closure flap 20 has a narrow portion 22 of the same length as the panel 12 and thereafter tapers in length. The portion 22 is defined by a longitudinal weakening line 24.

Adjacent to, but spaced from the weakening line 24, is a tear tape 26 which is applied to the closure flap 20. At the right end or side of the closure flap 20, there is a projecting tab 28 which carries an end portion of the tear tape or strip 26.

Adjacent a short free edge 30 of the closure flap 20 is a stripe of pressure sensitve adhesive 32 which is normally covered by a removable covering strip 34.

A second closure flap 36 is joined to a first edge of the panel 14 along a combined weakening and fold line 38. The closure 36 has a narrow portion 40 of the same length as the panel 14 and this narrow portion carries a tear strip or tape 42.

Both sides of the closure flap 36 taper in width although the right side, as viewed in FIG. 1 includes a projection 44 which is usable as a pull tab to effect removable of the closure flap 36 from the panel 14.

The closure flap 36 further has a narrow free edge 46 adjacent to which there is a stripe of pressure sensitive adhesive 48 which is covered by a removable covering strip 50.

At this time it is pointed out that the closure flap 36 is of a greater width than the closure flap 20 for a purpose which will be described in more detail hereinafter.

The panel 14 carries at opposite sides thereof closure flap 52, 54 which are folded around the folded over panel 12 and bonded thereto by glue (not shown) so as to form a pocket as will be described in more detail hereinafter. The closure flap or glue flap 52 carries a label panel 56 which is of a lesser width than the glue flap 52 and is connected thereto along a weakening line 58. The label panel also carries an anchoring flap 60 which is integrally connected to the label panel 56 along a second weakening line 62 so that the label 56 may be torn out. The flap 60 is bonded to the first panel 12 immediately adjacent the side or glue flap 54. This is due to the fact that the combined widths of the glue flaps 52, 54, the label panel 56 and the anchoring panel 60 are generally the same as, but slightly less than the width of the panel 14.

Figure 2:
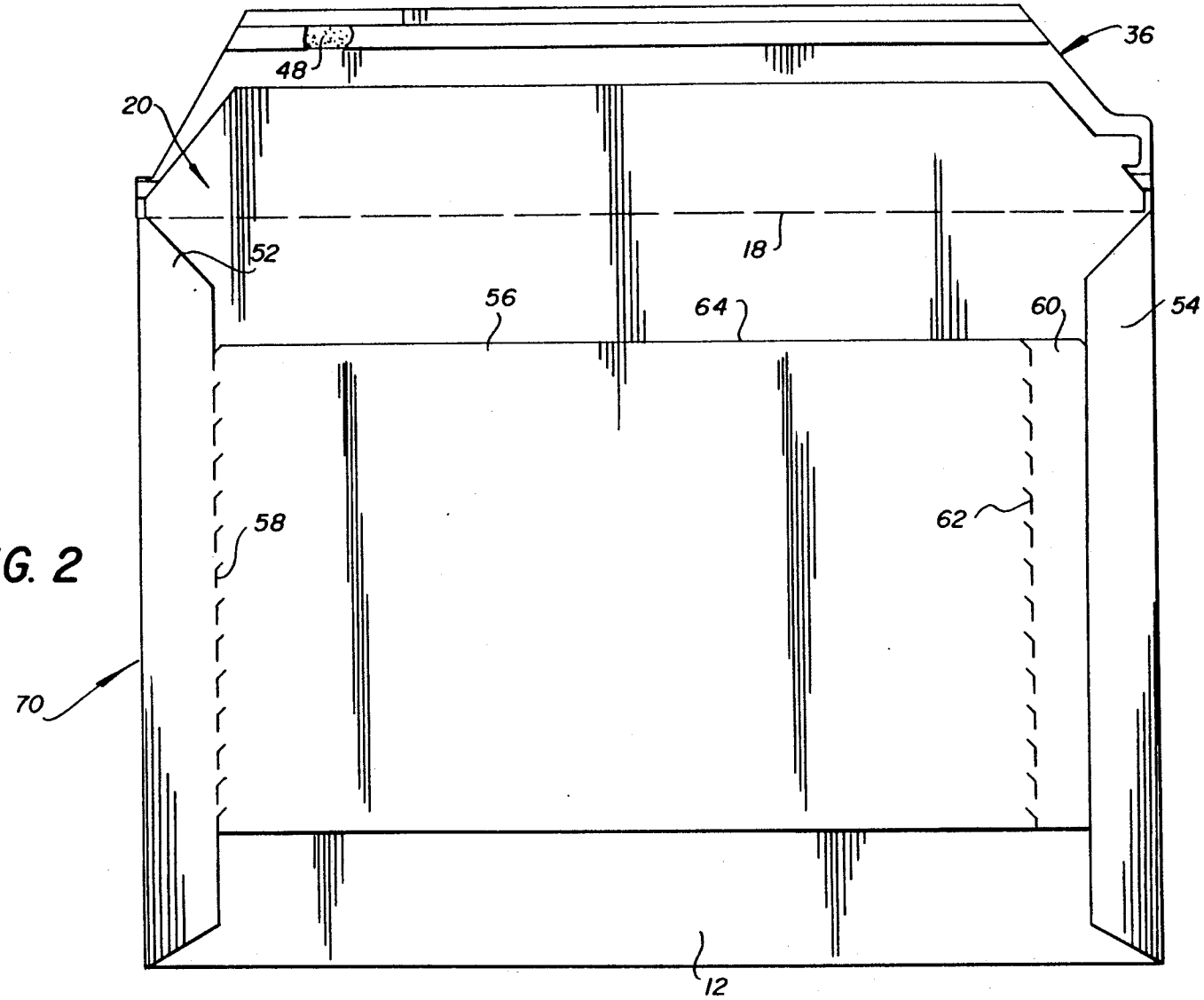
FIG. 2 is a plan view of the envelope formed from the blank of FIG. 1.

In use, the blank 10 is first folded along the fold line 16, after which the glue flaps 52, 54 are folded over so as to form a pocket. In the folding over and gluing of the glue flap 52 to the first panel 12, the label panel 56 is also folded over and the securing flap 60 thereof is adhesively bonded to the face of the first panel 12. The resultant envelope is generally identified by the numeral 70 and is best illustrated in FIG. 2. It is to be understood that the envelope 70, as shown in FIG. 2, is ready for a first mailing.

It is to be particularly noted that the first closure flap 20 is folded to a stored position during the first mailing and that the width of the first closure panel 20 is generally equal to or less than the spacing between the fold line 18 and a top edge 64 of the label panel 56. On the other hand, the spacing of the line of adhesive 48 on the second closure panel 56 from the fold line 58 is greater than the spacing between the fold line 18 and the top edge 64 of the label panel 56. In addition, the length of the closure panel 36 along the adhesive strip 48 is less than the length of the label panel 56 so that the second closure panel 36 bonds only to the label panel 56.

Figure 5:
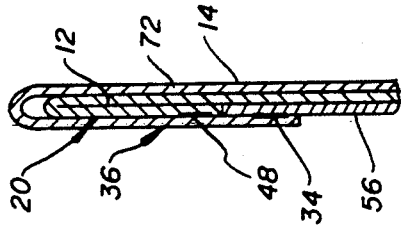
FIG. 5 is an enlarged fragmentary schematic sectional view taken generally along the line 5—5 of FIG. 4 and shows the relationship of the two closure flaps and the label panel upon first closing.
Figure 4:
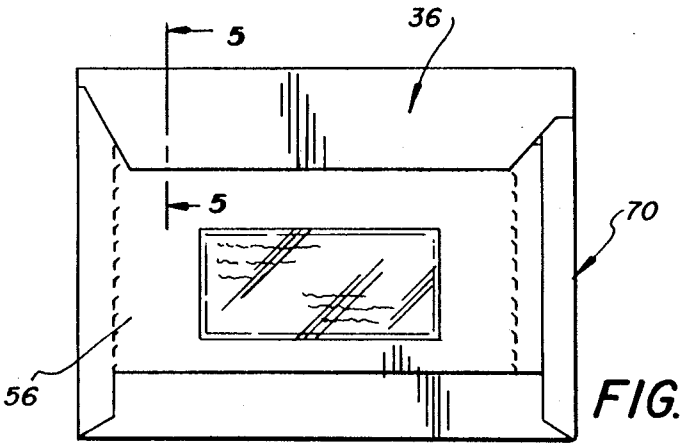
FIG. 4 is a plan view similar to FIG. 3 and shows the envelope closed and labeled ready for first mailing.

Thus after the desired papers are placed within the pocket of the envelope 70, the envelope 70 may be closed by folding the second closure panel 36 over the first closure panel 20 and bonding the second closure panel 36 to the label panel 56. At some time in this operation, the required mailing instructions are applied to the label panel 56 in the normal manner. These operation steps are shown in FIG. 4 and the pocket of the envelope 70 is identified in FIG. 5 by the reference numeral 72.

Figure 6:
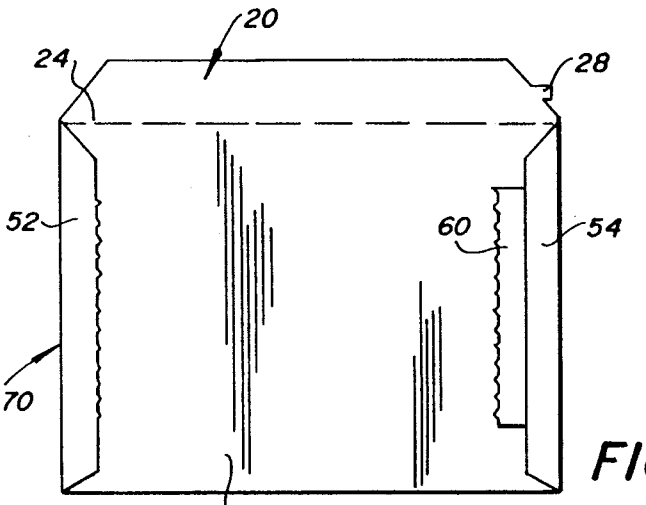
FIG. 6 is yet another plan view of the mailing envelope with the second closure flap and label panel removed and ready to receive a second mailing.

When the envelope 70 reaches its original destination, it is opened by pulling on the tab 44 and utilizing the tear strip 42 to tear the second closure panel 36 from the envelope along the weakening line 38. In the removal of the closure flap 36, the label panel 56 is also removed by tearing along its weakening lines 58, 62. The opened envelope, with the first closure flap 20 being folded upwardly, is illustrated in FIG. 6.

Figure 8:
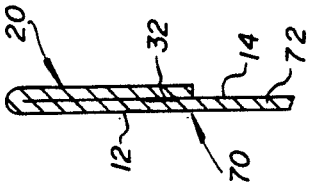
FIG. 8 is an enlarged fragmentary schematic view showing the manner in which the envelope is closed for the second mailing.
Figure 7:
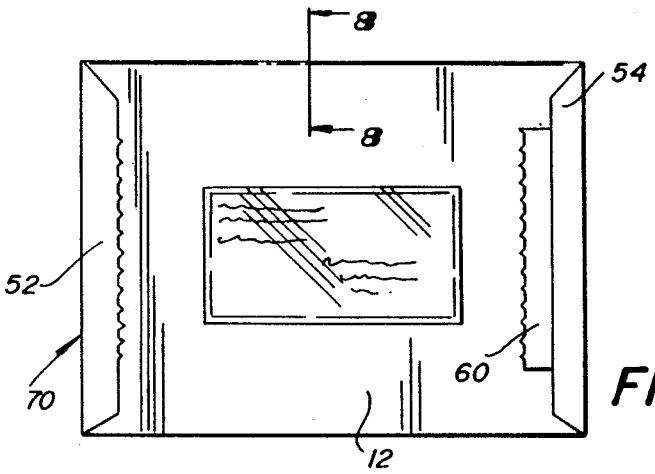
FIG. 7 is a yet another plan view of the envelope shown in FIG. 6 but with the mailing placed therein and the envelope closed by the first closure flap and additional mailing instructions applied to the first panel.
Figure 3:
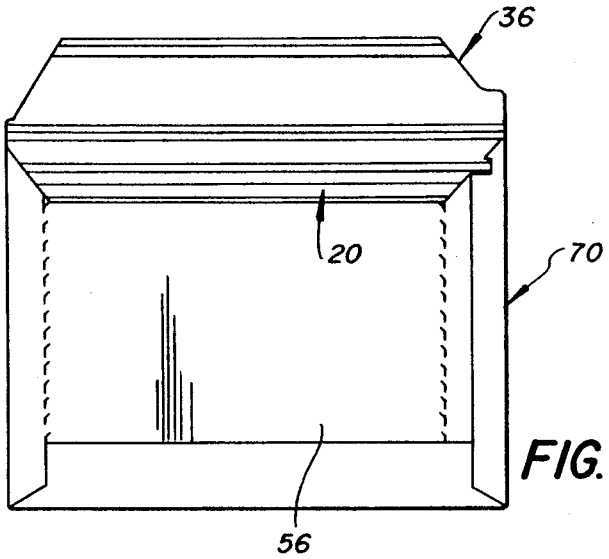
FIG. 3 is an elevational view on a smaller scale of the envelope of FIG. 2 with the first closure flap folded to an out of the way position and the envelope ready to receive mail and mailing instructions.

The pocket 72 is once again opened for receiving a remailing. Once the papers to be mailed utilizing the envelope 70 a second time have been placed in the pocket 72, the pocket 72 may again be sealed by folding the closure flap 20 down into overlapping relation with respect to the panel 14 and bonded thereto. Further, the required mailing instructions may now be applied to the panel 12, as is best shown in FIG. 7. The pocket 72 is again sealed utilizing the closure flap 20 as is best shown in FIG. 8.

When the envelope 70 reaches its second destination, the first flap 20 may be removed by pulling on the tab 28 and tearing the first closure flap 20 along its weakening line 24. The second mailing is now available and the envelope 70 is ready for discard.

Although only a preferred embodiment of the envelope and the blank from which it is formed have been specifically illustrated and described herein, it is to be understood that minor variations may be made in the envelope construction without departing from the spirit and scope of this invention as defined by the appended claims.

I claim:

1. A double use mailing envelope comprising a pocket including parallel first and second panels having remote first and second ends, said pocket being open at said first end, first and second closure flaps hingedly connected to respective ones of said first and second panels at said open end for sequentially closing said pocket, said closure flaps being of different widths with said second closure flap being of a greater width than said first closure flap and including a sealing strip area spaced greater from said first end than the width of said first closure flap, whereby said first closure flap may be first folded away from said open first end followed by sealing of said open first end by said second closure flap which overlies and conceals said first closure flap, followed by opening of said pocket and by reclosing of said pocket utilizing said first closure flap, and a removable label panel partially overlying said first panel spaced from said first end, said removable label panel being positioned below said first folded position of said first closure flap and forming that portion of said envelope to which said second closure flap is secured in the sealing of said pocket open end.

2. A mailing envelope according to claim 1 wherein said first closure flap has a tear strip for effecting a second opening of said pocket.

3. A mailing envelope according to claim 1 wherein said second closure flap has means for removing said second closure flap from said first panel together with said label panel as a unit wherein said first panel becomes a second label panel and said first closure flap may be sealed to said second panel to close said pocket a second time.

4. A mailing envelope according to claim 1 wherein said second closure flap has means for removing said second closure flap from said first panel together with said label panel.

5. A mailing envelope according to claim 1 wherein said second closure flap has means for removing said second closure flap from said first panel together with said label panel, said means including a weakened fold line joining said second closure flap to said second panel.

6. A mailing envelope according to claim 1 wherein said second closure flap has means for removing said second closure flap from said first panel together with said label panel, said means including a weakened fold line joining said second closure flap to said second panel and a tear strip on said second closure flap adjacent said weakened fold line.

7. A mailing envelope according to claim 1 wherein said label panel including remote flaps secured to said first panel and there being weakening lines between said label panel and said remote flaps.

8. A mailing envelope according to claim 7 wherein one of said remote flaps is a side sealing flap carried by said second panel and closing one side edge of said pocket.

9. A mailing envelope according to claim 8 wherein there is a separate second side sealing flap carried by said second panel and closing an opposite side edge of said pocket.

10. A blank for forming a double use mailing envelope, said blank being in one piece and formed of paperboard, said blank comprising first and second panels having remote first ends and being joined together at second ends, a first closure flap at said first panel first end and a second closure flap at said second panel first end, side flaps at side edges of one of said panels, and a label panel carried by one of said side flaps.

11. A blank according to claim 10 wherein said label panel is carried by said one side flap along a weakening line.

12. A blank according to claim 10 wherein said label panel carries a mounting flap remote from said one side flap.

13. A blank according to claim 10 wherein said side flaps are carried by said second panel.

14. A blank according to claim 12 wherein a combination of widths of said side flaps, said label panel and said mounting flap is generally equal to and no greater than a width of said second panel.

15. A blank according to claim 10 wherein said label panel is offset relative to said second panel first end a distance at least as great as a width of said first closure flap and less than a width of said second closure flap.

* * * * *